US011920455B1

(12) United States Patent
Zhang et al.

(10) Patent No.: US 11,920,455 B1
(45) Date of Patent: Mar. 5, 2024

(54) FRICTION FOR CUTTING PLUG

(71) Applicant: Landmark Graphics Corporation, Houston, TX (US)

(72) Inventors: Yuan Zhang, Missouri City, TX (US); Robello Samuel, Cypress, TX (US); Zhengchun Michael Liu, Sugar Land, TX (US)

(73) Assignee: Landmark Graphics Corporation, Houston, TX (US)

( * ) Notice: Subject to any disclaimer, the term of this patent is extended or adjusted under 35 U.S.C. 154(b) by 6 days.

(21) Appl. No.: 17/902,487

(22) Filed: Sep. 2, 2022

(51) Int. Cl.
*E21B 44/02* (2006.01)
*E21B 47/06* (2012.01)
*E21B 47/08* (2012.01)

(52) U.S. Cl.
CPC ..... *E21B 44/02* (2013.01); *E21B 47/06* (2013.01); *E21B 47/08* (2013.01)

(58) Field of Classification Search
CPC ..... E21B 44/02; E21B 47/06; E21B 47/08
See application file for complete search history.

(56) References Cited

U.S. PATENT DOCUMENTS 5,327,984 A 7/1994 Rasi et al.
2019/0323311 A1 10/2019 Al-Qasim et al.
2020/0173268 A1 6/2020 Zhang, Jr. et al.
2021/0140274 A1* 5/2021 Forshaw ..... E21B 37/00
2022/0205352 A1 6/2022 Mittal et al.
2022/0403709 A1* 12/2022 Clark ..... E21B 21/08

FOREIGN PATENT DOCUMENTS

CA 3023860 12/2017
KR 101637452 7/2016

OTHER PUBLICATIONS

"PCT Application No. PCT/US2023/065974, International Search Report and Written Opinion", dated Aug. 2, 2023, 10 pages.
Zhu, et al., "Numerical analysis of the stuck pipe mechanism related to the cutting bed under various drilling operations", Journal of Petroleum Science and Engineering, vol. 208, Part E, Nov. 4, 2021, 16 pages.

* cited by examiner

*Primary Examiner* — Brad Harcourt
(74) *Attorney, Agent, or Firm* — DeLizio, Peacock, Lewin & Guerra, LLP

(57) ABSTRACT

A method for controlling computerized operations related to a wellbore comprises drilling the wellbore in a subsurface formation with a drill string including a drill bit. The method comprises acquiring a plurality of drilling parameters while drilling the wellbore. The method comprises determining, based on the plurality of drilling parameters, solids properties for solids forming a cutting plug up hole of the drill bit. The method comprises determining a length of the cutting plug based on the solids properties. The method comprises determining a cutting plug friction force based on the cutting plug length and a pressure differential across the cutting plug. The method comprises performing a drilling operation based on the cutting plug friction force.

20 Claims, 6 Drawing Sheets

FRICTION FOR CUTTING PLUG

FIELD

Embodiments of the inventive subject matter relate generally to the field of drilling for hydrocarbons and more particularly to the field of forces acting on a drill string.

BACKGROUND

Operations for drilling a wellbore in a subsurface formation with a drill string can include determining the forces on a drill string. Many factors can contribute to forces on the drill string such as friction forces. Understanding these factors can aid in avoiding damage to the drill string when displacing the drill string in and out of the wellbore.

BRIEF DESCRIPTION OF THE FIGURES

The present invention is illustrated by way of example and not limitation in the Figures of the accompanying drawings in which.

OVERVIEW

In operations for drilling a wellbore in a subsurface formation, a drill bit of a drill string forms the wellbore by crushing or scraping the rock of the subsurface formation. The small pieces of rock that result from the crushing/scraping action may be called cuttings. Cuttings and other solids, such as cavings (solids from the wellbore that may not have been removed directly from the crushing/scraping action), may be transported back to surface via the flow of drilling fluid. However, a portion of the cuttings may be deposited in the wellbore. When pulling (i.e., tripping) a drill string out of the wellbore, solids that may have accumulated in the wellbore may form a cutting plug up hole of the drill bit. The cutting plug may add additional friction to the drill string as it is tripped out of the wellbore.

Some embodiments of the inventive subject matter provide techniques for determining the length of the cutting plug. For example, some embodiments include a computerized simulation processor that may determine the length of the cutting plug based on solids properties (i.e., a cumulative volume of the deposited cuttings and cavings). Some embodiments also may provide techniques for determining the cutting plug friction force. For example, the simulation processor may determine a cutting plug friction force based on the length of the cutting plug and a pressure differential across the cutting plug that may be caused by drilling fluid flowing through the cutting plug.

In some implementations, the cutting plug friction force may be used when performing a drilling operation. For example, drilling operations may be initiated, modified, or stopped based on the cutting plug friction force. Examples of such drilling operations may include rotating the drill string, lowering the drill string back into the wellbore, increasing the flow rate of drilling fluid, etc. For instance, the cutting plug friction force may increase a friction factor on the drill string such that the friction factor exceeds a drag force threshold for the drill string to be tripped out of the wellbore. Accordingly, drilling operations may be adjusted to reduce the cutting plug friction force and safely trip the drill string out of the wellbore.

Example Systems

Figure 1:
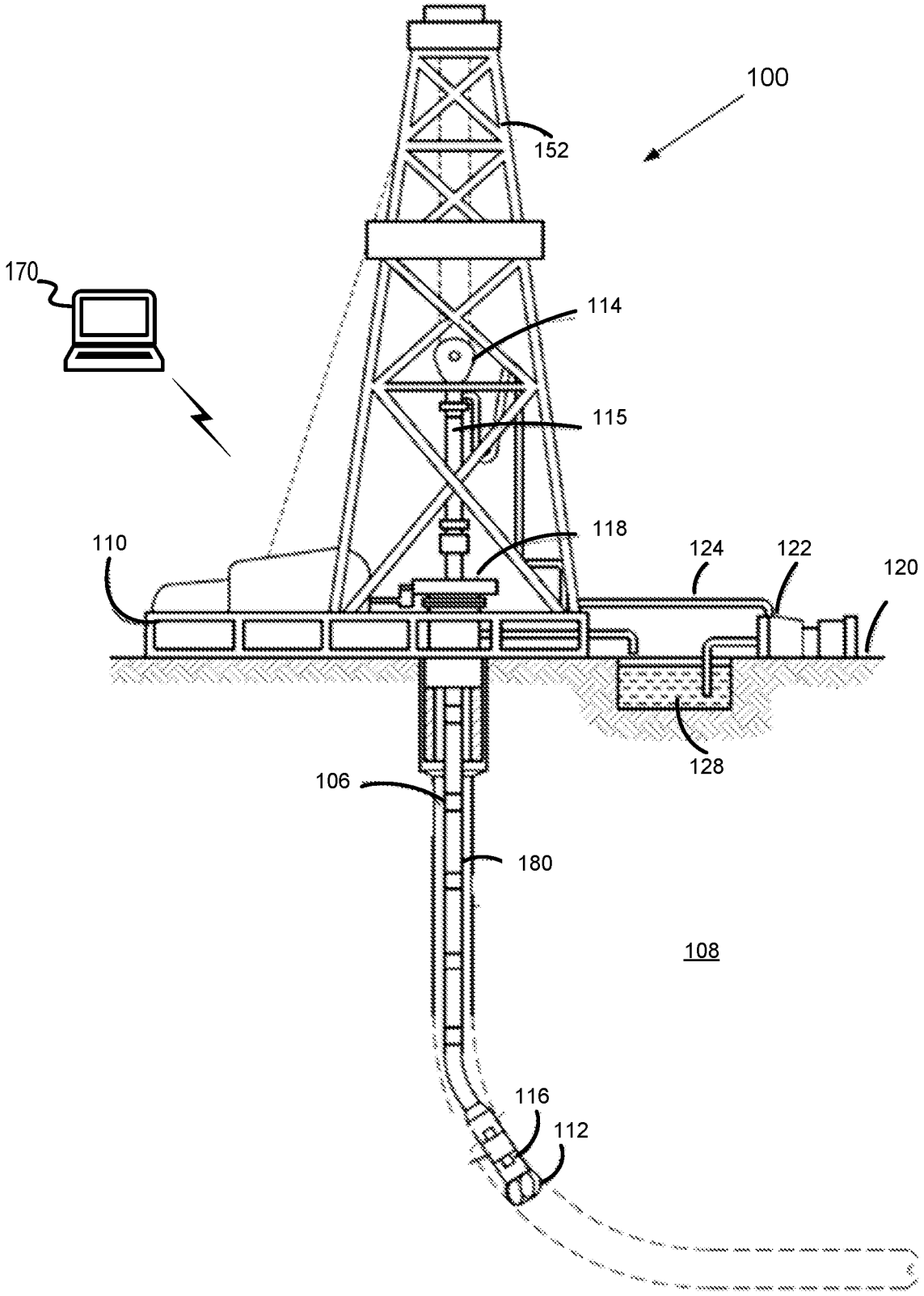
FIG. 1 depicts an example well system, according to some embodiments.

FIG. 1 depicts an example well system, according to some embodiments. In particular, FIG. 1 is a schematic diagram of a well system 100 that includes a drill string 180 having a drill bit 112 disposed in a wellbore 106 for drilling the wellbore 106 in the subsurface formation 108. While depicted for a land-based well system, example embodiments can be used in subsea operations that employ floating or sea-based platforms and rigs.

The well system 100 may further include a drilling platform 110 that supports a derrick 152 having a traveling block 114 for raising and lowering the drill string 180. The drill string 180 may include, but is not limited to, drill pipe, drill collars, and down hole tools 116. The down hole tools 116 may comprise any of a number of different types of tools including measurement while drilling (MWD) tools, logging while drilling (LWD) tools, mud motors, and others. A kelly 115 may support the drill string 180 as it may be lowered through a rotary table 118. The drill bit 112 may include roller cone bits, polycrystalline diamond compact (PDC) bits, natural diamond bits, any hole openers, reamers, coring bits, and the like. As the drill bit 112 rotates, it may crush or scrape rock to create and extend a wellbore 106 that penetrates various subterranean formations. The drill bit 112 may be rotated by various methods including rotation by a downhole mud motor and/or via rotation of the drill string 180 from the surface 120 by the rotary table 118. Attributes of drilling the wellbore may be adjusted to increase, decrease, and/or maintain the rate of penetration (ROP) of the drill bit 112 through the subsurface formation 108. Attributes may include weight-on-bit (WOB) and rotations-per-minute (RPM) of the drill string 180. A pump 122 may circulate drilling fluid through a feed pipe 124 to the kelly 116, downhole through interior of the drill string 180, through orifices in the drill bit 112, back to the surface 120 via an annulus surrounding the drill string 180, and into a retention pit 128. The drilling fluid may transport cuttings and cavings back to surface 120 via the annulus. In some instances, the drill bit 112 may become dull and lose efficiency, thus requiring the drill string 180 to be tripped out of the wellbore 106. In some instances, cutting and caving may not return to surface 120 and instead may be deposited up hole of the drill bit 112 in the wellbore 106. The cuttings and cavings may form a cutting plug when the drill string 180 is tripped out of the wellbore 106.

Figure 6:
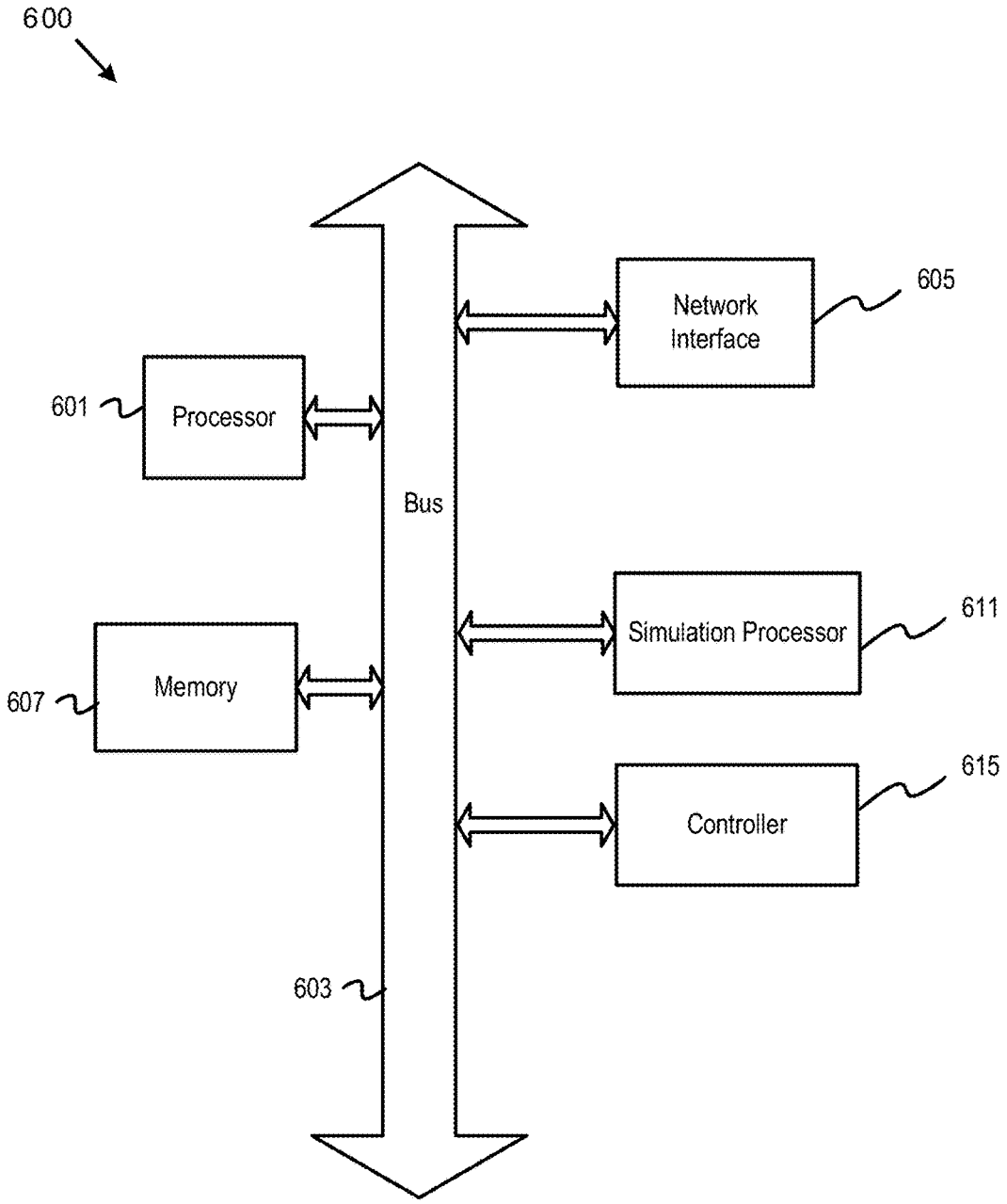
FIG. 6 depicts an example computer, according to some embodiments.

The well system 100 includes a computer 170 that may be communicatively coupled to other parts of the well system 100 such as sensors on surface, LWD tools, MWD tools, etc. The computer 170 can be local or remote to the drilling platform 110. A processor of the computer 170 may have perform simulations (as further described below) that determine friction forces associated with a cutting plug. In some embodiments, the processor of the computer 170 may control drilling operations of the well system 100 or subsequent drilling operations of other wellbores. An example of the computer 170 is depicted in FIG. 6, which is further described below.

Figure 2A:
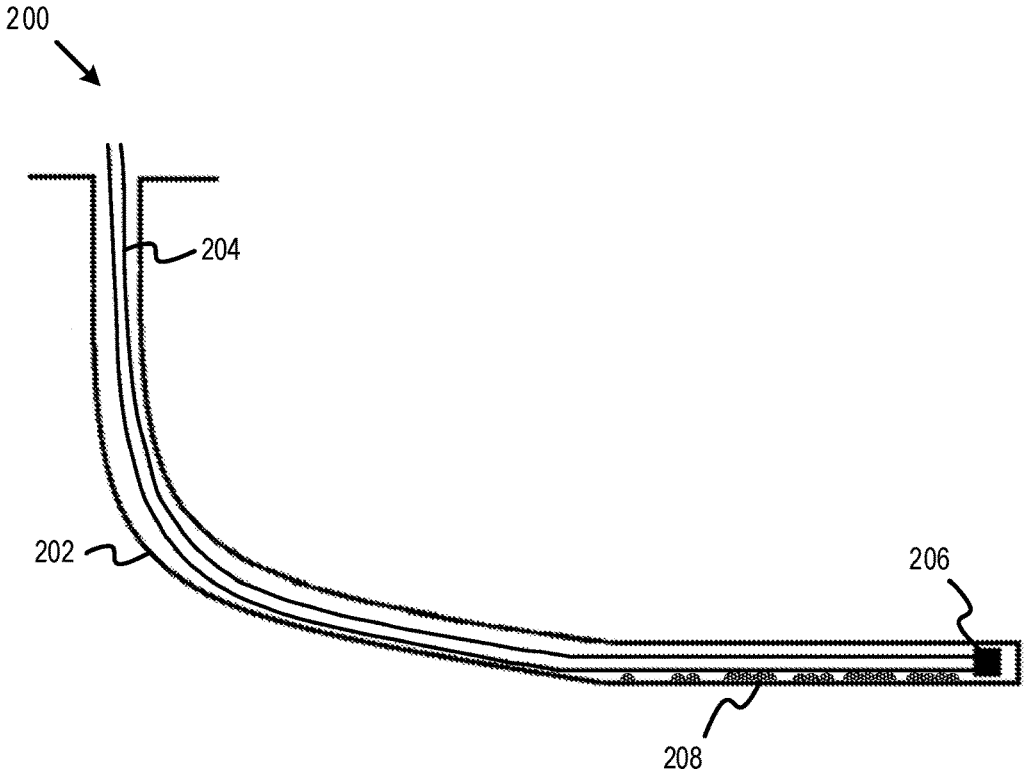
FIGS. 2A-2B depict example diagrams of a solids in a wellbore, according to some embodiments.
Figure 2B:
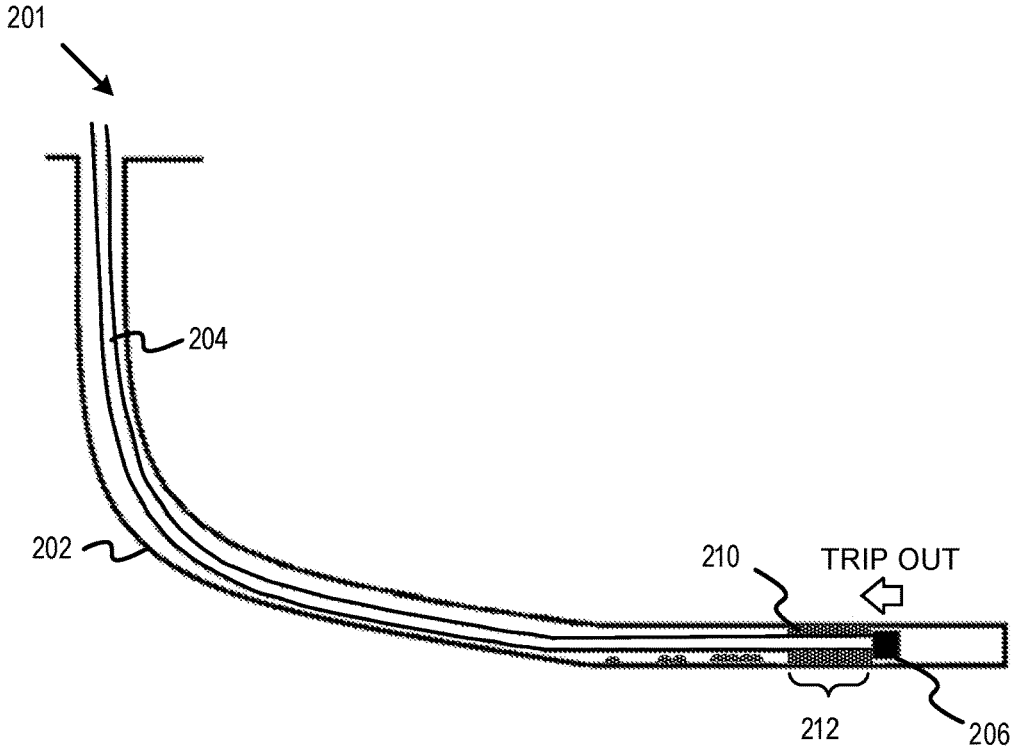

FIGS. 2A-2B depict example diagrams of a solids in a wellbore, according to some embodiments. FIG. 2A depicts an example well system 200 that includes a wellbore 202 in a subsurface formation. The wellbore 202 is being formed by a drill bit 206 of a drill string 204. As the drill bit 206 rotates, the drill bit 206 crushes and/or scrapes the rock of the subsurface formation to create cuttings. Drilling mud or other drilling fluids (including compressed air, nitrogen, etc.) may be pumped through the drill string 204, out of the drill bit 206, and up the annulus (formed by the wellbore 202 and the drill string 204) to transport the cuttings back to surface. In some instances, at least a portion of the cuttings may be deposited in the wellbore, and accumulate up hole of the drill bit 206 (i.e., towards the surface), to form a cutting bed 208. Cavings may also form by pieces of the subsurface formation falling from the wellbore, but the pieces may not have been removed directly from the action of the drill bit. Cavings may also contribute to the cutting bed 208. Cutting bed 208 may form due to a plurality of reasons including a low pump rate of the drilling fluid, a high rate of penetration (ROP) of the drill bit 206, caving of the wellbore 202, etc.

FIG. 2B depicts an example well system 201 of the drill string 204 being tripped out of the wellbore 202. The cutting bed may form a cutting plug 210 up hole of the drill bit 206 and at least partially encase the drill string 204 as the drill string 204 is tripped out of the wellbore 202. As the drill bit is moved up hole, the drill bit 206 may collect the cuttings such that they accumulate against the drill bit 206 and/or around the drill string 204, forming the cutting plug 210. In some embodiments, it may be assumed that all of the suspended cutting may pass through the channels of the drill bit to be transported to surface or deposited in the cutting bed 208. The cutting plug 210 may alter the drag force on the drill string 204 as it is tripped out of the wellbore 202. For example, the drill string 204 may experience a drag force due to the friction between the drill pipe (and other drilling components) and the wellbore 202. The cutting plug friction force may increase the drag force on the drill string 204 as it is tripped out of the wellbore 202. In some embodiments, the cutting plug length 212 may be determined to determine the cutting plug friction force. Operations to determine the cutting plug length 212 and the cutting plug friction force will be described in FIG. 3.

Example Operations

Figure 3:
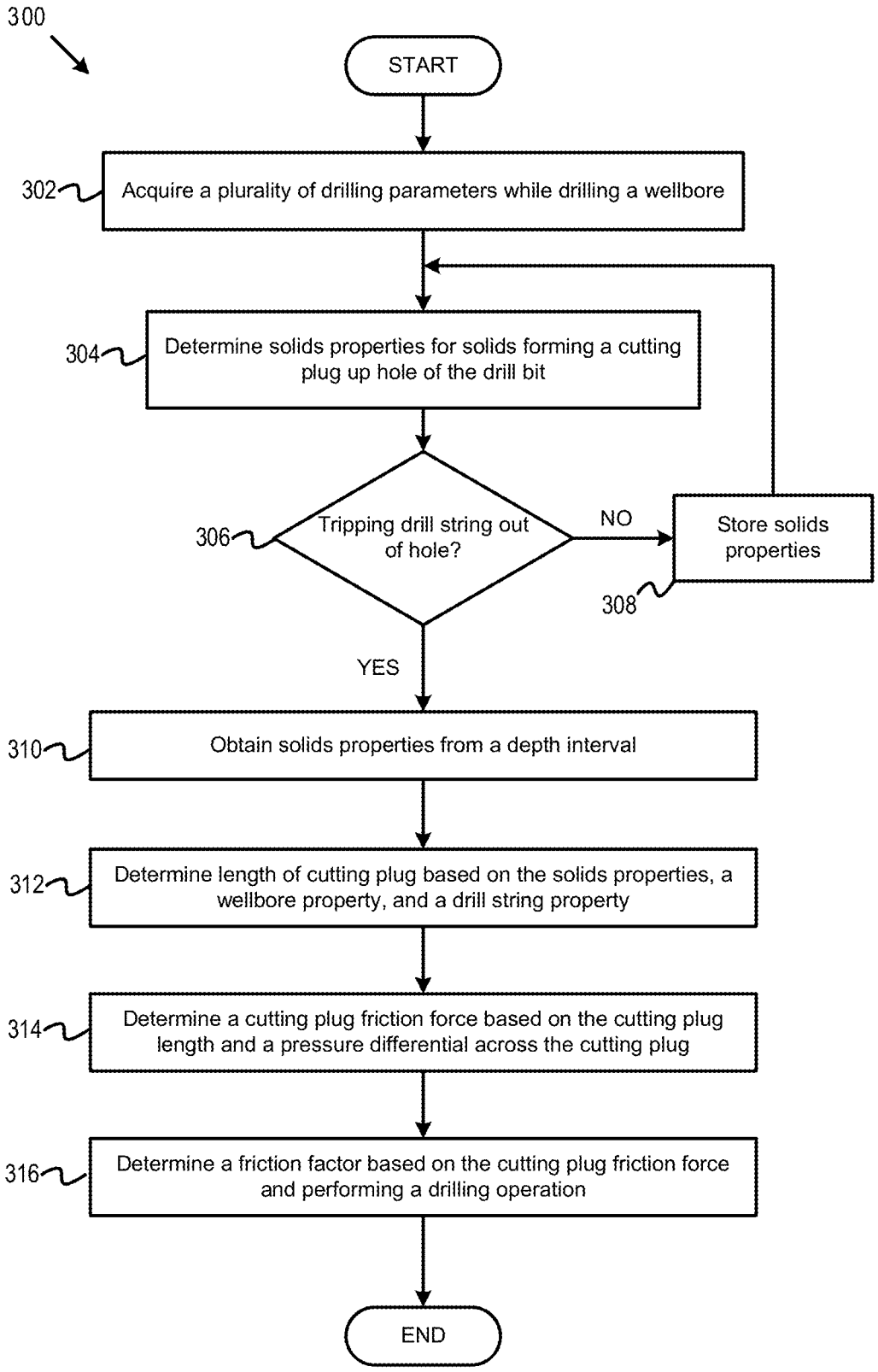
FIG. 3 depicts a flowchart of example operations for determining a cutting plug friction force, according to some embodiments.

FIG. 3 depicts a flowchart of example operations for determining a cutting plug friction force, according to some embodiments. Operations of flowchart 300 of FIG. 3 are described in reference to the computer 170 of FIG. 1. The computer 170 may perform any or all of the operations described with reference to FIG. 3. Operations of the flowchart 300 start at block 302.

At block 302, a plurality of drilling parameters may be acquired while drilling the wellbore. The drilling parameters may be acquired in (quasi) real-time while drilling the wellbore. Drilling parameters may include the rate-of-penetration (ROP) the drill bit is moves through the subsurface formation, the weight-on-bit (WOB), the torque-on-bit (TOB), rotations-per-minute (RPM) of the drill bit, flow rate of the drilling fluid being pumped into the drill string, the flow rate of drilling fluid returning to surface from the wellbore annulus, positional measurement of the drill bit in the subsurface formation (i.e., measured depth, true vertical depth, inclination, azimuth), etc. Sensors may be located on surface and downhole on the drill string to measure the drilling parameters. The drilling parameters may be communicated to the computer 170.

At block 304, solids properties may be determined for solids forming a cutting plug up hole of the drill bit. The computer 170 may determine one or more solids properties. The cutting plug may be formed by the accumulation of solids over a depth interval of the wellbore. For instance, the depth interval may start at a measured depth (MD) where the drill bit begins drilling a wellbore and may end at the measured depth when the drill string is tripped out of the wellbore. Once the drill string is tripped back in the wellbore to begin drilling again, a new depth interval may begin. For example, if the drill string were tripped in a wellbore and the drill bit started drilling at 10,000 feet MD and stopped drilling at 15,000 feet MD to trip out the drill string, the depth interval would be 5,000 feet. Solids properties may be determined at various depths within the depth interval. For example, the solids properties may be determined every 10 feet, 30, feet, 90 feet, etc. while drilling the depth interval. Solids properties may also be determined each time drilling parameters are received while drilling the depth interval.

Solids properties may include a settled-cutting volume and a settled caving volume. The settled-cutting volume may be determined based on drilling parameters and the cutting bed height at each depth within the depth interval. For example, a first model (such as a Wellplan Hydraulic model) may use data including the drilling parameters and cutting bed height at each depth within the depth interval to determine the settled-cutting volume. The settled-caving volume may be determined based on the drilling parameters. For example, a second model (such as a Geomechanical Caving model) may use data including the drilling parameters to determine the settled-caving volume. Additionally, other cutting and caving information may be determined while drilling. For example, a packoff percent of the wellbore may be determined based on the settled-cutting volume, settled-caving volume, and annular area between the wellbore and the drill string.

At block 306, a determination is made of whether the drill string is to be tripped out of the wellbore. For example, if the ROP drops below a threshold, the decision may be made to trip out the drill string to replace the drill bit. The computer 170 may make the determination at block 306. If the drill string is not to be tripped out and drilling continues, then operations proceed to block 308. Otherwise, operation proceed to block 310

At block 308, the solids properties may be stored. For example, the solids properties may be communicated and stored by the computer 170. Operations of the flowchart 300 then return to the operation at block 304 to determine and/or update the solids properties for the depth interval as drilling continues.

At block 310, the solids properties may be obtained for the depth interval. For example, the solids properties corresponding to the depth interval may be obtained from where the data was stored on computer 170. Other data may also be obtained, such as packoff percent of the wellbore.

At block 312, the length of the cutting plug may be determined based on the solids properties, a wellbore property, and a drill string property. To calculate the cutting plug length, a cumulative plug volume may first be determined using Equation 1:

$$\text{cumulative plug volume}=\Sigma(\text{settled-cutting volume}+\text{settled-caving volume}) \quad (1)$$

Where the summation of the settled-cutting volume and settled-caving volume is the summation over the depth interval. The cumulative plug volume may depict the volume of accumulated solids that form the cutting plug. With the cumulative plug volume, the cutting plug length may be determined using Equation 2:

$$\text{cutting plug length}=\text{cumulative plug volume}/\text{annular section-area} \quad (2)$$

Where the annular section-area may annular area between the wellbore and drill string. The annular section-area may be determined with a wellbore property, such as the diameter of the wellbore, and a drill string property, such as the outer diameter of the drill string. The annular section-area may also consider other factors such as cave effects, washout intervals, etc.

At block 314, the cutting plug friction force may be determined based on the cutting plug length and a pressure differential across the cutting plug. In some embodiments, determining the cutting plug friction force may include determining a fluid drag force between a flow of the drilling fluid and the cutting plug, a self-weight drag force of the cutting plug, and a side friction force between the wellbore and the cutting plug. In some embodiments, the cutting plug friction force may be a summation of the fluid drag force, the self-weight drag force, and the side friction force. To illustrate, FIGS. 4A-4B depict example diagrams of drag forces from a cutting plug, according to some embodiments.

Figure 4A:
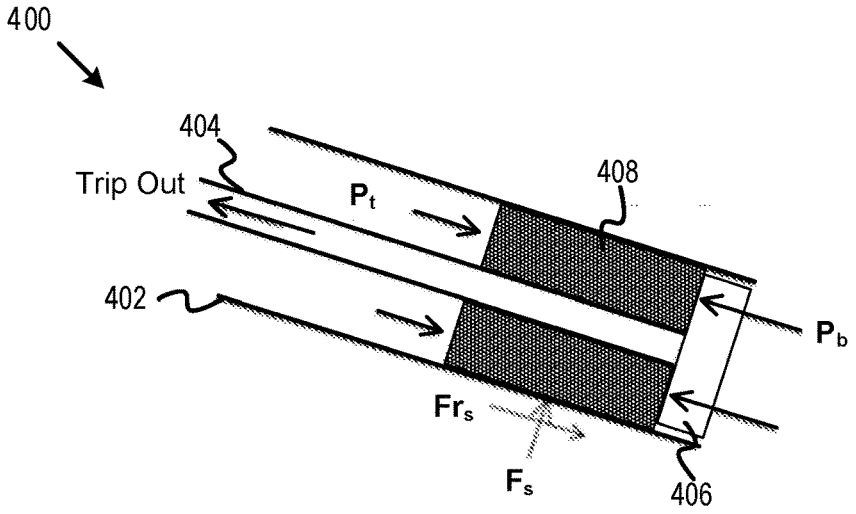
FIGS. 4A-4B depict example diagrams of drag forces from a cutting plug, according to some embodiments.
Figure 4B:
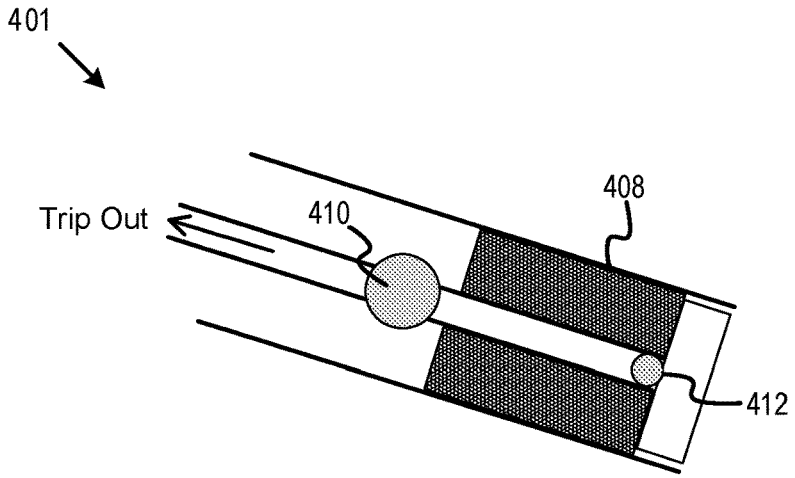

FIG. 4A depicts a well system 400 with a drill string 404 encapsulated by a cutting plug 408. As the drill string 404 is pulled out of the wellbore 402, the drill bit 406 may collect solids to form the cutting plug 408. In some embodiments, the cutting plug 408 may be permeable such that drilling fluid may flow through the cutting plug. As drilling fluid is pumped through the drill string 404, out of the drill bit 406, and through the cutting plug 408 located in the annular area between the wellbore 402 and the drill string 404, a pressure differential may be created across the cutting plug 408. The pressure differential may be determined by difference between the top pressure, Pt, and the bottom pressure, Pb. The fluid drag force may be determined based on the differential pressure across the cutting plug. The fluid drag force may be determined with Equation 3:

$$F=dp*\text{Area} \quad (3)$$

Where F is the fluid drag force, dp is the differential pressure across the cutting plug, and Area is the annular section-area between the wellbore and the drill string. In some embodiments, the pressure differential may be determined by a model which may assume that the cutting plug is a non-permeable, solid body. The model may determine the pressure differential based on parameters including the speed in which the drill string is tripped out of the wellbore. In some embodiments, the differential pressure may be determined by pressure sensors on the drill string. FIG. 4B depicts a well system 401 with a pressure sensor 412 located near or on the drill bit and a pressure sensor 410 located approximately close to the top of the cutting plug 408. In some embodiments, (quasi) real-time pressure measurements may be obtained to determine the pressure differential across the cutting plug 408.

The self-weight drag force may be determined by the weight of the solids. For example, the weight of the solids may be the total weight of the cuttings and cavings that have accumulated in the wellbore. In some embodiments, the weight of the solids may be reduced by the buoyancy force of the drilling fluid acting on the solids.

The side friction force (depicted as $Fr_s$ in well system 400 of FIG. 4) may be the friction between the cutting plug 408 and the wellbore 402. The side friction force may be determined by the side normal force (depicted as $F_s$ in well system 400 of FIG. 4), and a friction factor, as shown in Equation 4.

$$F=*N \quad (4)$$

Where $F_f$ us the side friction force, μ is the friction coefficient, and N is the side normal force. In some instances, the angle of the wellbore may be considered in the determination of the side friction force. For example, the angle of the wellbore relative to a wellbore inclination of zero degrees may be considered.

Figure 5A:
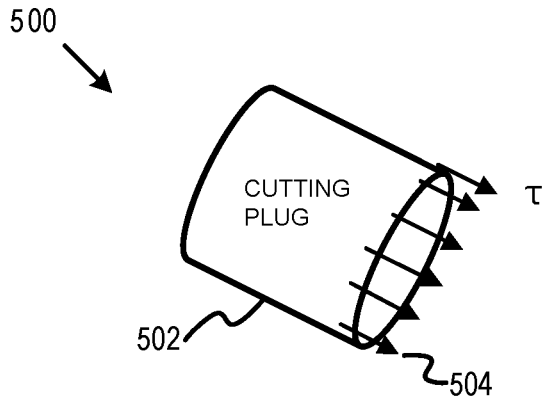
FIG. 5A-5B depict example diagrams of the cutting plug shear stress for side friction force, according to some embodiments.
Figure 5B:
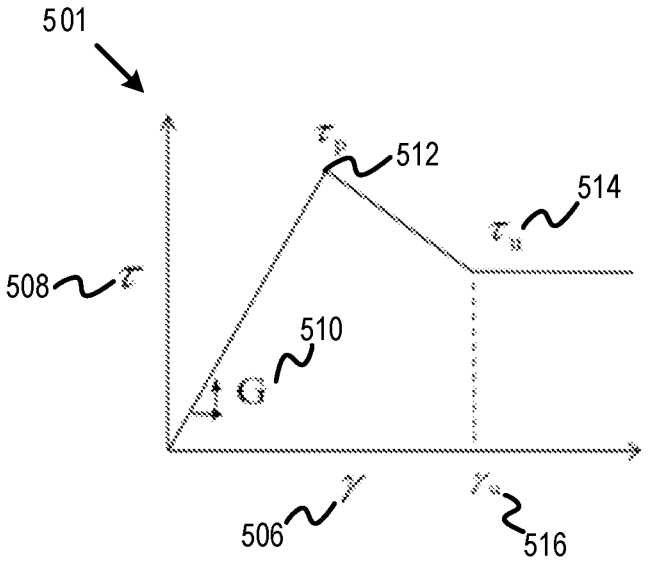

In some embodiments, the side friction force may be determined from the interfacial shear stress between the cutting plug and the wellbore. To illustrate, FIG. 5A-5B depict example diagrams of the cutting plug shear stress for side friction force, according to some embodiments. The side friction force may be determined with Equation 5.

$$F_f=\text{contact area}*\text{interfacial shear stress} \quad (5)$$

Where the contact area may be the base perimeter of the cutting plug cylinder multiplied by the cutting plug length. The interfacial shear stress may be determined by testing. For example, cuttings and cavings from different rock types may exhibit different shear stress vs. shear strain behavior. Various combinations of rock types may be used in testing to determine the interfacial shear stress. FIG. 5A depicts a cutting plug diagram 500 with cutting plug 502 and interfacial shear stress 504 acting on the cutting plug 502. FIG. 5B depicts a chart 501 of a shear stress vs. shear strain curve that may be created during testing to determine the interfacial shear stress. FIG. 5B depicts the chart 501 having an x-axis 506 and a y-axis 508. The x-axis 506 is the shear strain and the y-axis 508 is the shear stress. The slope 510, represented by G, may indicate the shear modulus of elasticity. $\tau_p$ is the proportional limit 512, $\tau_u$ is the ultimate shear stress 514, and $\gamma_u$ may represent the upper limit of the strain hardening region 516 and/or the lower limit of the plastic region. The computer 170 may perform any of the computations described with reference to FIGS. 4A-5B.

Referring back to FIG. 3, at block 316, a friction factor may be determined based on the cutting plug friction force and a drilling operation may be performed. A friction factor may indicate the friction force on the drill string when tripping out of the wellbore. In some instances, the friction factor indicates the friction force, such as the friction force between the wellbore and the drill string, applied to the drill string when tripping out of the wellbore. In some embodiments, the cutting plug friction force may be considered with the other friction forces acting on the drill string to determine the friction forces on the drill string. Thus, the friction factor may indicate all forces, including forces induced by the cutting plug, acting on the drill string.

In some instances, the well system may have a friction factor threshold. For example, the threaded connections between drill pipes or other drill string components may have a maximum allowable tension force (i.e., force due to weight and friction factor), the body of the drill pipe and drill string components may have a maximum allowable tension force, the derrick or drawworks of the drilling rig may have a maximum allowable weight capacity, etc. If the friction factor is greater than a threshold such that any one of the aforementioned components of the well system may fail, then a drilling operation may need to be performed to reduce the friction factor. As stated above, drilling operations may include rotating the drill string, lowering the drill string back into the wellbore, increasing the flow rate of drilling fluid, etc. If the friction factor is less than a threshold, than the drill string may be pulled up the wellbore.

Example Computer

FIG. 6 depicts an example computer, according to some embodiments. FIG. 6 depicts a computer 600 that includes a processor 601 (possibly including multiple processors, multiple cores, multiple nodes, and/or implementing multi-threading, etc.). The computer 600 includes a memory 607. The memory 607 may be system memory or any one or more of the above already described possible realizations of machine-readable media. The computer 600 also includes a bus 603 and a network interface 605.

The computer 600 also includes a simulation processor 611 and a controller 615. The simulation processor 611 and the controller 615 can perform one or more of the operations described herein. For example, the simulation processor 611 may determine the length of the cutting plug and the cutting plug friction force as described herein (e.g., see discussion of FIGS. 3-5B). The controller 615 can perform various control operations to a drilling operation based on the output from the simulation processor 611. For example, the controller 615 increase the flow rate of the drilling fluid and rotate the drilling string.

Any one of the previously described functionalities may be partially (or entirely) implemented in hardware and/or on the processor 601. For example, the functionality may be implemented with an application specific integrated circuit, in logic implemented in the processor 601, in a co-processor on a peripheral device or card, etc. Further, realizations may include fewer or additional components not illustrated in FIG. 6 (e.g., video cards, audio cards, additional network interfaces, peripheral devices, etc.). The processor 601 and the network interface 605 are coupled to the bus 603. Although illustrated as being coupled to the bus 603, the memory 607 may be coupled to the processor 601.

While the aspects of the disclosure are described with reference to various implementations and exploitations, it will be understood that these aspects are illustrative and that the scope of the claims is not limited to them. In general, determining the cutting plug length and the cutting plug friction force as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

This description includes example systems, methods, techniques, and program flows that embody embodiments of the disclosure. However, this disclosure may be practiced without these specific details. For instance, this disclosure refers to determining the cutting plug friction force based on the differential pressure across the cutting plug. Embodiments of this disclosure may also be used to determine the cutting plug friction force based on other parameters associated with the cutting plug. In other instances, well-known instruction instances, protocols, structures, and techniques have not been shown in detail in order not to obfuscate the description.

EXAMPLE EMBODIMENTS

Embodiment #1: A method for controlling computerized operations related to a wellbore, comprising: drilling the wellbore in a subsurface formation with a drill string including a drill bit; acquiring a plurality of drilling parameters while drilling the wellbore; determining, based on the plurality of drilling parameters, solids properties for solids forming a cutting plug up hole of the drill bit; determining a length of the cutting plug based on the solids properties; determining a cutting plug friction force based on the cutting plug length and a pressure differential across the cutting plug; and performing a drilling operation based on the cutting plug friction force.

Embodiment #2: The method of Embodiment #1 further comprising determining a friction factor based on the cutting plug friction force.

Embodiment #3: The method of Embodiment #2 further comprising determining the friction factor is less than a threshold and pulling the drill string up the wellbore after determining the friction factor is less than the threshold.

Embodiment #4 The method of one or more of Embodiments #1-3, wherein determining the length further comprises determining the length based on a wellbore property and a drill string property, wherein the wellbore property includes a diameter of the wellbore and the drill string property includes an outer diameter of the drill string.

Embodiment #5: The method of one or more of Embodiments #1-4, wherein the solids properties include a settled-cutting volume and a settled-caving volume.

Embodiment #6: The method of Embodiment #5 further comprising determining the length based on a cumulative plug volume of the cutting plug, wherein the cumulative plug volume of the cutting plug is based on a sum of the settled-cutting volume and the settled-caving volume over a depth interval.

Embodiment #7: The method of one or more of Embodiments #1-6, wherein determining the cutting plug friction force further comprises: determining a fluid drag force between a flow of drilling fluid and the cutting plug, wherein the fluid drag force is based on the pressure differential across the cutting plug, determining a self-weight drag force of the cutting plug, and determining a side friction force of the wellbore.

Embodiment #8: A non-transitory computer-readable medium including computer-executable instructions comprising: instructions to drill a wellbore in a subsurface formation with a drill string including a drill bit; instructions to acquire a plurality of drilling parameters while drilling the wellbore; instructions to determine, based on the plurality of drilling parameters, solids properties for solids forming a cutting plug up hole of the drill bit; instructions to determine a length of the cutting plug based on the solids properties; instructions to determine a cutting plug friction force based on the cutting plug length and a pressure differential across the cutting plug; and instructions to perform a drilling operation based on the cutting plug friction force.

Embodiment #9: The non-transitory computer-readable medium of Embodiment #8 further comprising: instructions to determine a friction factor based on the cutting plug friction force.

Embodiment #10: The non-transitory computer-readable medium of Embodiment #9 further comprising instructions to determine the friction factor is less than a threshold and pulling the drill string up the wellbore after determining the friction factor is less than the threshold.

Embodiment #11: The non-transitory computer-readable medium of one or more of Embodiments #8-10, wherein instructions to determine the length further comprises determining the length based on a wellbore property and a drill string property, wherein the wellbore property includes a diameter of the wellbore and the drill string property includes an outer diameter of the drill string.

Embodiment #12: The non-transitory computer-readable medium of one or more of Embodiments #8-11, wherein the solids properties include a settled-cutting volume and a settled-caving volume.

Embodiment #13: The non-transitory computer-readable medium of Embodiment #12 further comprising instructions to determine the length based on a cumulative plug volume of the cutting plug, wherein the cumulative plug volume of the cutting plug is based on a sum of the settled-cutting volume and the settled-caving volume over a depth interval.

Embodiment #14: The non-transitory computer-readable medium of one or more of Embodiments #8-13, wherein instructions to determine the cutting plug friction force further comprises: instructions to determine a fluid drag force between a flow of drilling fluid and the cutting plug, wherein the fluid drag force is based on the pressure differential across the cutting plug, instructions to determine a self-weight drag force of the cutting plug, and instructions to determine a side friction force of the wellbore.

Embodiment #15: A system comprising: a drill string including a drill bit; a processor; and a computer-readable medium having instructions stored thereon that are executable by the processor, the instructions including instructions to drill a wellbore in a subsurface formation with drill bit; instructions to acquire a plurality of drilling parameters while drilling the wellbore; instructions to determine, based on the plurality of drilling parameters, solids properties for solids forming a cutting plug up hole of the drill bit; instructions to determine a length of the cutting plug based on the solids properties; instructions to determine a cutting plug friction force based on the cutting plug length and a pressure differential across the cutting plug; and instructions to perform a drilling operation based on the cutting plug friction force.

Embodiment #16: The system of Embodiment #15 further comprising: instructions to determine a friction factor based on the cutting plug friction force; and instructions to determine the friction factor is less than a threshold and pulling the drill string up the wellbore after determining the friction factor is less than the threshold.

Embodiment #17: The system of one or more of Embodiments #15 or #16, wherein instructions to determine the length further comprises determining the length based on a wellbore property and a drill string property, wherein the wellbore property includes a diameter of the wellbore and the drill string property includes an outer diameter of the drill string.

Embodiment #18: The system of one or more of Embodiments #15-17, wherein the solids properties include a settled-cutting volume and a settled-caving volume.

Embodiment #19: The system of Embodiment #18 further comprising instructions to determine the length based on a cumulative plug volume of the cutting plug, wherein the cumulative plug volume of the cutting plug is based on a sum of the settled-cutting volume and the settled-caving volume over a depth interval.

Embodiment #20 The system of one or more of Embodiments #15-19, wherein instructions to determine the cutting plug friction force further comprises: instructions to determine a fluid drag force between a flow of drilling fluid and the cutting plug, wherein the fluid drag force is based on the pressure differential across the cutting plug, instructions to determine a self-weight drag force of the cutting plug, and instructions to determine a side friction force of the wellbore.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed.

The invention claimed is:

1. A method for controlling computerized operations related to a wellbore, comprising:

drilling the wellbore in a subsurface formation with a drill string including a drill bit;

acquiring a plurality of drilling parameters while drilling the wellbore;

determining, based on the plurality of drilling parameters, solids properties for solids forming a cutting plug up hole of the drill bit;

determining a length of the cutting plug based on the solids properties;

determining a cutting plug friction force based on the cutting plug length and a pressure differential across the cutting plug; and performing a drilling operation based on the cutting plug friction force.

2. The method of claim 1 further comprising determining a friction factor based on the cutting plug friction force.

3. The method of claim 2 further comprising determining the friction factor is less than a threshold and pulling the drill string up the wellbore after determining the friction factor is less than the threshold.

4. The method of claim 1, wherein determining the length further comprises determining the length based on a wellbore property and a drill string property, wherein the wellbore property includes a diameter of the wellbore and the drill string property includes an outer diameter of the drill string.

5. The method of claim 1, wherein the solids properties include a settled-cutting volume and a settled-caving volume.

6. The method of claim 5 further comprising determining the length based on a cumulative plug volume of the cutting plug, wherein the cumulative plug volume of the cutting plug is based on a sum of the settled-cutting volume and the settled-caving volume over a depth interval.

7. The method of claim 1, wherein determining the cutting plug friction force further comprises:

determining a fluid drag force between a flow of drilling fluid and the cutting plug, wherein the fluid drag force is based on the pressure differential across the cutting plug, determining a self-weight drag force of the cutting plug, and determining a side friction force of the wellbore.

8. A non-transitory computer-readable medium including computer-executable instructions comprising:

instructions to drill a wellbore in a subsurface formation with a drill string including a drill bit;

instructions to acquire a plurality of drilling parameters while drilling the wellbore;

instructions to determine, based on the plurality of drilling parameters, solids properties for solids forming a cutting plug up hole of the drill bit;

instructions to determine a length of the cutting plug based on the solids properties;

instructions to determine a cutting plug friction force based on the cutting plug length and a pressure differential across the cutting plug; and instructions to perform a drilling operation based on the cutting plug friction force.

9. The non-transitory computer-readable medium of claim 8 further comprising:

instructions to determine a friction factor based on the cutting plug friction force.

10. The non-transitory computer-readable medium of claim 9 further comprising instructions to determine the friction factor is less than a threshold and pulling the drill string up the wellbore after determining the friction factor is less than the threshold.

11. The non-transitory computer-readable medium of claim 8, wherein instructions to determine the length further comprises determining the length based on a wellbore property and a drill string property, wherein the wellbore property includes a diameter of the wellbore and the drill string property includes an outer diameter of the drill string.

12. The non-transitory computer-readable medium of claim 8, wherein the solids properties include a settled-cutting volume and a settled-caving volume.

13. The non-transitory computer-readable medium of claim 12 further comprising instructions to determine the length based on a cumulative plug volume of the cutting plug, wherein the cumulative plug volume of the cutting plug is based on a sum of the settled-cutting volume and the settled-caving volume over a depth interval.

14. The non-transitory computer-readable medium of claim 8, wherein instructions to determine the cutting plug friction force further comprises:

instructions to determine a fluid drag force between a flow of drilling fluid and the cutting plug, wherein the fluid drag force is based on the pressure differential across the cutting plug, instructions to determine a self-weight drag force of the cutting plug, and instructions to determine a side friction force of the wellbore.

15. A system comprising:

a drill string including a drill bit;

a processor; and a computer-readable medium having instructions stored thereon that are executable by the processor, the instructions including instructions to drill a wellbore in a subsurface formation with drill bit;

instructions to acquire a plurality of drilling parameters while drilling the wellbore;

instructions to determine, based on the plurality of drilling parameters, solids properties for solids forming a cutting plug up hole of the drill bit;

instructions to determine a length of the cutting plug based on the solids properties;

instructions to determine a cutting plug friction force based on the cutting plug length and a pressure differential across the cutting plug; and instructions to perform a drilling operation based on the cutting plug friction force.

16. The system of claim 15 further comprising:

instructions to determine a friction factor based on the cutting plug friction force; and instructions to determine the friction factor is less than a threshold and pulling the drill string up the wellbore after determining the friction factor is less than the threshold.

17. The system of claim 15, wherein instructions to determine the length further comprises determining the length based on a wellbore property and a drill string property, wherein the wellbore property includes a diameter of the wellbore and the drill string property includes an outer diameter of the drill string.

18. The system of claim 15, wherein the solids properties include a settled-cutting volume and a settled-caving volume.

19. The system of claim 18 further comprising instructions to determine the length based on a cumulative plug volume of the cutting plug, wherein the cumulative plug volume of the cutting plug is based on a sum of the settled-cutting volume and the settled-caving volume over a depth interval.

20. The system of claim 15, wherein instructions to determine the cutting plug friction force further comprises:

instructions to determine a fluid drag force between a flow of drilling fluid and the cutting plug, wherein the fluid drag force is based on the pressure differential across the cutting plug, instructions to determine a self-weight drag force of the cutting plug, and instructions to determine a side friction force of the wellbore.

* * * * *